United States Patent [19]

Bunce et al.

[11] Patent Number: 4,969,776

[45] Date of Patent: Nov. 13, 1990

[54] OFFSHORE PLATFORMS

[75] Inventors: James W. Bunce, Sittingbourne; Andrew P. Hollis, Horsham; Peter R. Wood, Ashtead, all of England

[73] Assignee: British Gas PLC, London, England

[21] Appl. No.: 17,499

[22] Filed: Feb. 24, 1987

[30] Foreign Application Priority Data

Feb. 24, 1986 [GB] United Kingdom ..... 8604543

[51] Int. Cl.[5] ..... E02B 17/00

[52] U.S. Cl. ..... 405/203; 405/197; 405/207

[58] Field of Search ..... 405/196–200, 405/203, 204, 207, 208, 195; 254/105–112; 175/5, 9; 166/335, 339

[56] References Cited

U.S. PATENT DOCUMENTS

| | | | |
|---|---|---|---|
| 2,667,038 | 1/1954 | Bayley | 405/207 |
| 2,846,851 | 8/1958 | Pelham | 405/197 |
| 2,953,904 | 9/1960 | Christenson | 405/196 |
| 2,960,833 | 11/1960 | Hayward . | |
| 2,984,075 | 5/1961 | Suderow | 405/197 |
| 3,426,859 | 2/1969 | Manning | 405/197 X |
| 3,429,127 | 2/1969 | Donkers | 405/196 |
| 3,450,201 | 6/1969 | Blenkarn . | |
| 3,474,749 | 10/1969 | Williamson | 405/196 X |
| 3,916,632 | 11/1975 | Thomas | 405/196 |
| 3,927,535 | 12/1975 | Giblon . | |
| 3,967,458 | 7/1976 | Scales | 405/196 |
| 3,987,636 | 10/1976 | Hruska et al. | 405/227 X |
| 4,117,691 | 10/1978 | Spray | 405/191 X |
| 4,135,841 | 1/1979 | Watkins | 405/196 |
| 4,472,081 | 9/1984 | Lawson | 405/169 |

FOREIGN PATENT DOCUMENTS

| | | | |
|---|---|---|---|
| 28281/77 | 8/1977 | Australia . | |
| 209196 | 5/1960 | Austria | 405/196 |
| 39590 | 11/1981 | European Pat. Off. . | |
| 2282021 | 3/1976 | France . | |
| 19811 | 2/1985 | Japan | 405/196 |
| 85112 | 5/1985 | Japan | 405/203 |
| 1273990 | 5/1972 | United Kingdom . | |
| 1402452 | 8/1975 | United Kingdom . | |
| 1408689 | 10/1975 | United Kingdom . | |
| 1515328 | 6/1978 | United Kingdom . | |
| 1561270 | 2/1980 | United Kingdom . | |

*Primary Examiner*—Randolph A. Reese
*Assistant Examiner*—John A. Ricci
*Attorney, Agent, or Firm*—Larson and Taylor

[57] ABSTRACT

A marine structure, for example an offshore production plantform comprises a floating base section, which can be flooded, having caissons thereon and a topsides mounted on the caissons. The caissons comprise at least two telescopic sections,the uppermost section carrying the topsides and the lowermost being mounted on the base. The structure can be installed by supporting hte topsides for example, using the derrick of a jack-up rig, and then partially flooding the base section until the jack-up rig is supporting the topsides. On lowering the hook, more of the topsides weight is applied to the base and the structure sinks to the sea-bed where it is secured by grouting. The upper supported section is then lifted to the desired height and the telescopic sections locked. Piling and drill casings, strings etc. may be lowered through the topsides into the hollow regions within the legs.

7 Claims, 4 Drawing Sheets

OFFSHORE PLATFORMS

This invention relates to offshore structures and, more particularly, to structures utilized as oil or gas production platforms.

One of the major costs in the development of marine production wells is the provision of the sub and above-sea structures housing the production equipment. Nearly half of the development costs can be taken up in the installation of the platforms.

With marginal fields, although they may contain sizeable reserves, it may not be economical to develop them because of the installation costs. The present invention seeks to alleviate these economic disadvantages by providing offshore structures which can be installed readily and economically without the need for specialised installation equipment.

In accordance with the present invention there is provided a marine structure including a hollow base, adapted to be flooded with water, at least one topsides deck and a plurality of hollow caissons connecting the topsides to the base, characterised in that each of said caissons comprises at least two telescopic sections, one section being arranged to move slidably within another and in that said topsides are adapted to permit passage therethrough of casings and drillstrings directly into and out of the hollow regions of said caissons.

The present invention further provides a method for the installation of such structures which comprises: positioning the structure, whilst it is floating, over its location, with the telescopic sections of the caisson fully retracted, supporting the topsides, at least partially flooding the base to create negative buoyancy, thereby causing the base to sink to the sea-floor by reducing the support on the topsides, securing the base on the sea floor, raising the topsides and upper caisson sections to a desired working height and fixing the caisson sections to prevent relative movement therebetween.

The platform design consists of a base which may be a cellular raft of high strength lightweight concrete supporting a number of legs or caissons and a superstructure containing, for example, the wellheads, control modules, separator and power generation facilities and a small helideck.

The platform is designed to be self floating from the construction site to its offshore installation site and to be set on the seabed whilst supported by the jack-up rig which will subsequently drill the wells. An expensive marine spread solely for sea transport and offshore installation purposes is avoided.

In a preferred mode of operation the structure is towed to its working location and secured by slings to the hook of a pre-positioned jack-up drilling rig. The raft section is then partially flooded to give negative buoyancy and put load on the derrick hook. The buoyancy of the hook may be reduced such that the hook load is about one third of the weight of the structure. The entire structure is then lowered by the derrick hook until the raft section touches the sea-floor. After fully ballasting and securing the raft section in its working position the derrick hook is raised. This extends the telescopic caissons and raises the topsides to their desired working height whereupon the caissons are locked.

The invention will be illustrated by reference to the accompanying drawings in which.

Figures 1, 3:
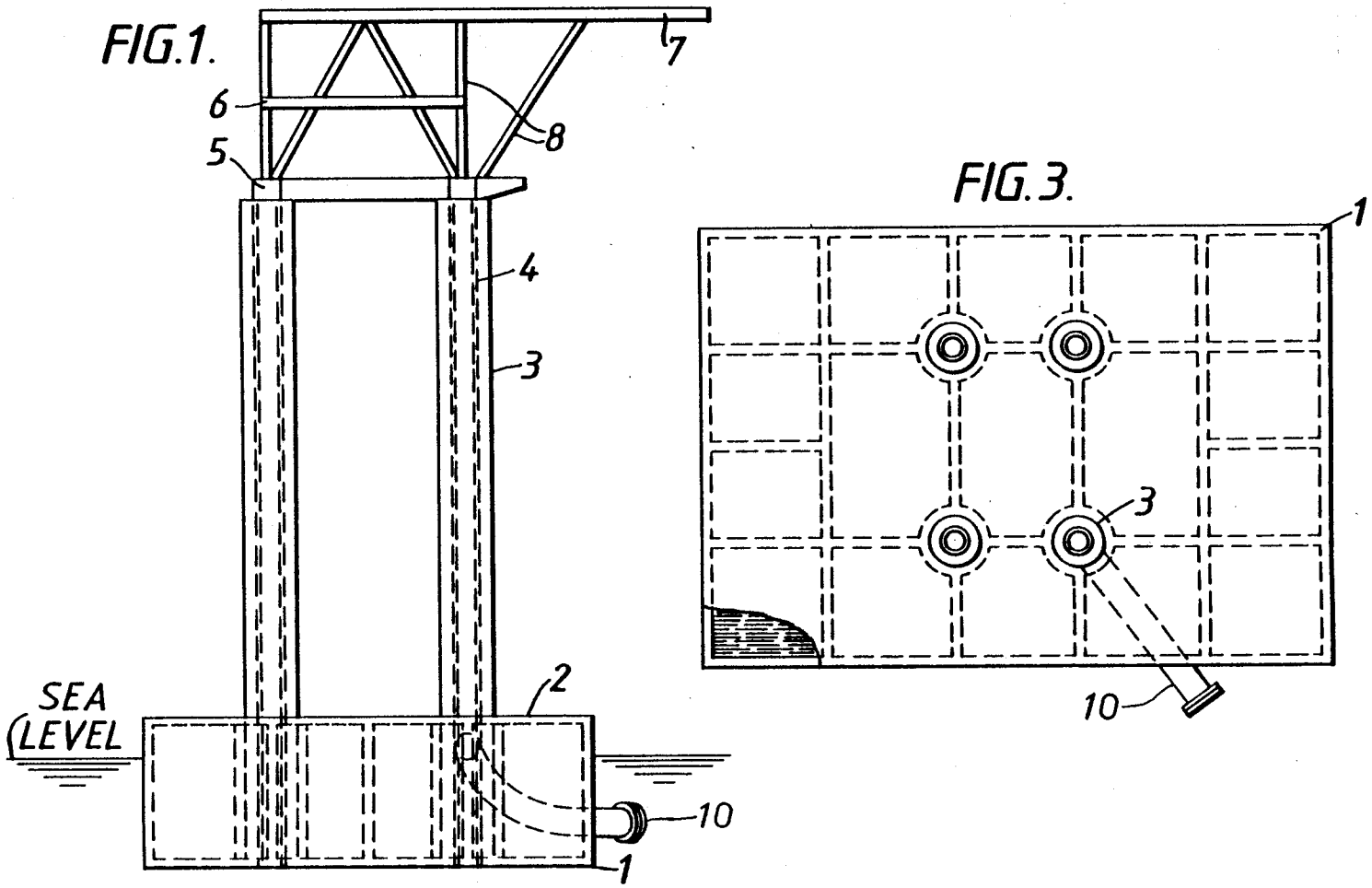
FIG. 1 is a view in elevation of the platform in transit configuration.
FIG. 3 is a view in plan of the raft section.
Figure 2:
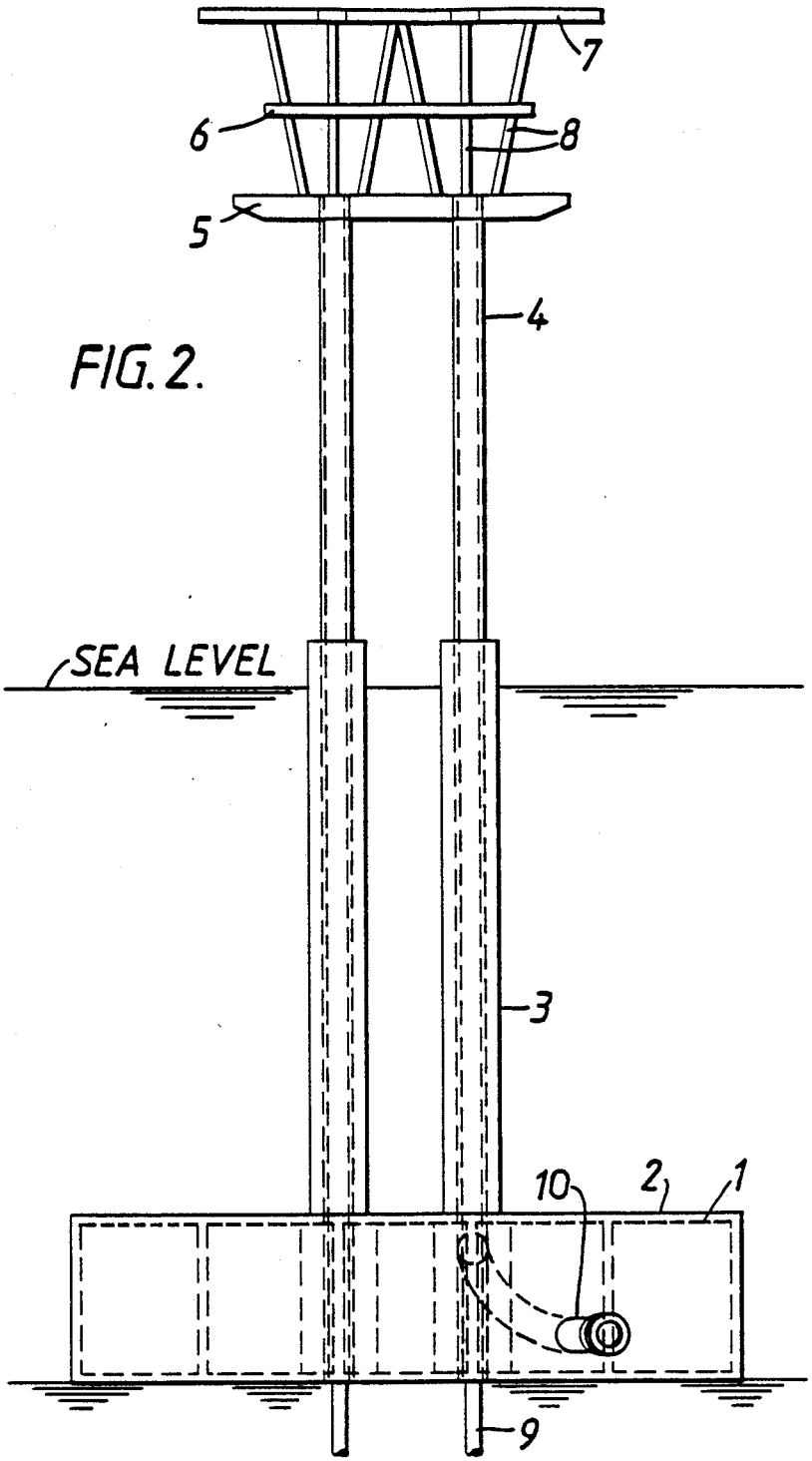
FIG. 2 is a view in elevation of the platform in installed configuration.

FIGS. 4–7 schematically depicts views in elevation of the steps of installation of the platform.

Referring to the drawings, the structure consists essentially of a raft or base section, a number of caissons and a super structure.

The raft 1 is of cellular construction having cast into it the four lower caissons 3. The top deck (2) of the raft is made of steel. Provision may be made for providing horizontal access to one of the caissons by casting in a J-tube 10 at the same time as the lower caissons. The upper caissons 4 have an OD which is smaller than the ID of the lower caissons 3. Thus, on insertion, the upper caissons will slideably fit within the inside of the lower caisson so that it can be telescoped inside the lower caisson during sea transport to reduce the centre-of-gravity height and improve stability. Secured to the upper end of the upper caissons is the superstructure or topsides. This may comprise a lower deck 5, an upper deck 6 and above that a landing deck (7) for helicopters. The arrangement of the bracings 8 is such that wellhead controls, e.g. the "christmas tree", may be accomodated.

On the lower deck, plant (not shown) such as the generators, pumps, manifolds may be located. Similarly the upper deck may house the personnel shelter and storage. Any equipment mounted on the decks should be arranged such that there exists co-axial access to the hollow regions of the caissons.

In construction and installation the following steps are taken:

(1) The raft is constructed by conventional shuttering methods in a suitable drydock or sheet piled beach area. The lower caissons and J tube are cast in and the upper caissons are inserted.

(2) The superstructure is built and precommissioned at a nearby fabrication site.

(3) The superstructure is lifted on and welded to the upper caissons.

(4) The main jack-up rig is positioned at the location and the platform is towed out to it.

Figure 4:
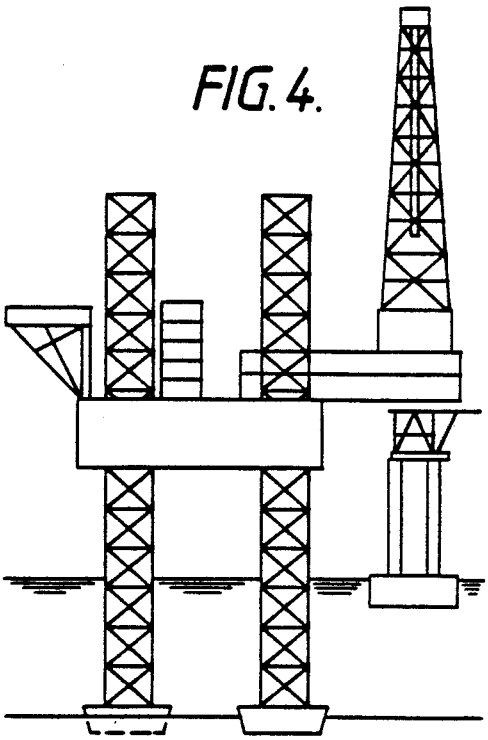

(5) With the jack-up in position and the rig cantilever extended the platform is moored adjacent to the jack-up (FIG. 4).

(6) Lifting tackle is lowered from the derrick hook and attached to the platform superstructure.

(7) The outer ballast compartments of the raft are part flooded until, for example, about 700,000 lb. (317800 Kg) hook load is indicated on the derrick.

Figure 5:
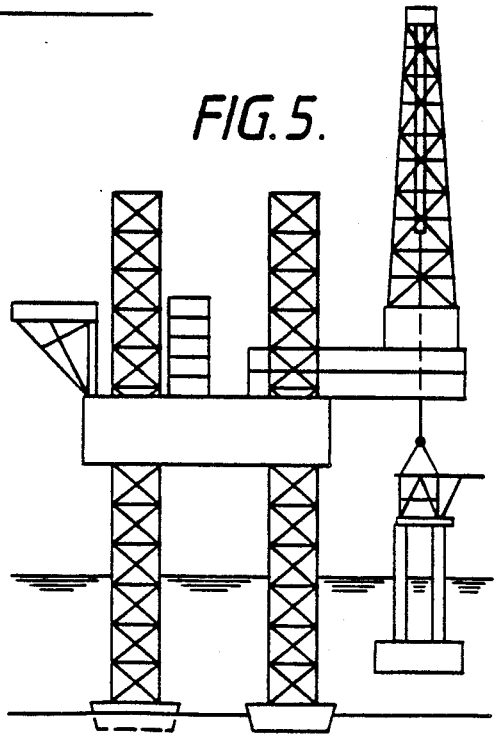

(8) The platform is lowered on the derrick hook with the central ballast compartments of the raft being flooded progressively as the platform descends to maintain the 317800 Kg hook load (FIG. 5).

Figure 6:
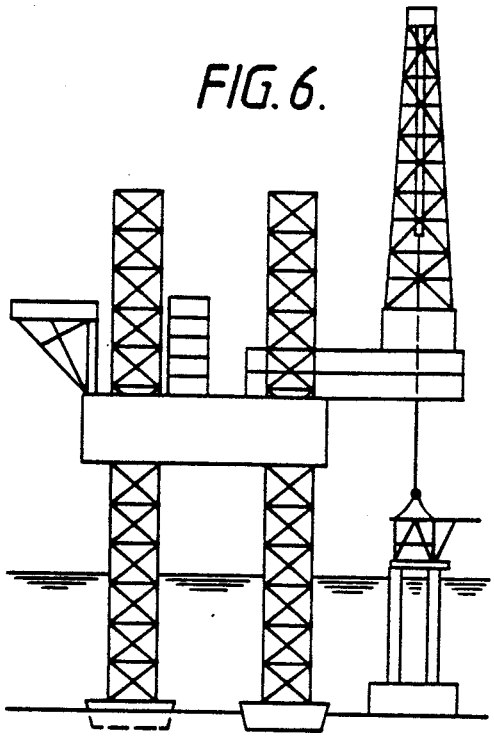

(9) When the raft is satisfactorily positioned on the seabed grout is injected under the base to provide levelling adjustment (FIG. 6).

(10) Once plumb and level on the seabed, any remaining ballast compartments are fully flooded.

Figure 7:
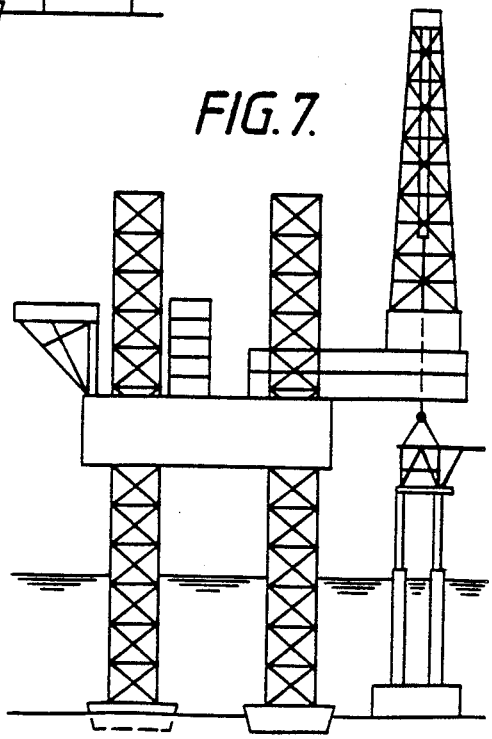

(11) The jack-up derrick then lifts the superstructure to the desired height above the design wave crest level and the caisson joint connections are made either by shimming and welding or by a mechanical means such as, for example, "Hydrolok" (FIG. 7).

(12) The lifting slings are removed and the drilling rig is skidded over the first slot to drive a conductor 9. The conductor provides a pile for securing the platform. Once driven the conductor/piling is cemented in. Further conductors are run and cemented. Inner primary conductors are then driven and the wells drilled normally and tied back to the platform.

(13) A flexible pipeline spool piece is pulled in by the rig through the cast in J tube in one of the caissons and the connection made to the export pipeline. A diving support vessel is provided for this operation.

(14) Minor additional equipment items (e.g. vent booms, crane, service water and waste caissons) may be added whilst the jack-up is alongside.

Drilling the wells is done from the main jack-up rig through the caissons of the platform. Thus, the platform provides a drilling template during the drilling phase.

After completion of the wells, the main jack-up rig is removed, leaving the platform as the above sea structure.

The platform will accommodate the tie-back of three wells drilled down three of the caissons and a gas export line run down the fourth caisson. The caissons thus fulfill the dual functions of supporting the superstructure and protection of the wells and export line against environmental and accident loadings.

We claim:

1. A method for installing a marine structure of the type including a topsides deck which, in its final operating position, is supported at a working level above sea level on a base which is located on a sea floor, the method comprising initially supporting the deck at an initial distance above the base, Floating the base on a surface of a sea with the deck supported at the initial distance and hence at a first level above the sea surface, moving the base to a point where the deck is to assume its final operating position, sinking the base to the sea floor so that simultaneously the deck descends to a second level above the sea surface which is below the working level, while partially supporting the structure with a jack-up rig while the deck is descending from its first level to the second level, and subsequently raising the deck to its working level wherein the initial distance of the deck above the base is greater than a distance between the surface of the sea and the sea floor at the point where the deck is to assume its final operating position in order that the deck at the second level is located above the surface of the sea.

2. A method as claimed in claim 1 in which the base is a hollow raft adapted to be flooded with water so that the floating step includes maintaining the base empty whereby the base floats on the surface of the sea and the sinking step includes flooding the base with water.

3. A method as claimed in claim 1 in which said supporting step includes the providing of a plurality of legs mounted on the base, each leg having at least two telescopic sections which are relatively slidable longitudinally, and wherein said raising step includes sliding one telescopic section relative to the other for each leg to cause the deck to be raised to the working level.

4. A method as claimed in claim 3 in which the deck is at the first level when the legs are fully retracted and in which the deck is at working level when the legs are at least partially extended.

5. A method as claimed in claim 3, including, once the deck has assumed the working level, the further steps of fixing each respective one telescopic section to the other to prevent relative movement therebetween, and of strengthening each leg by inserting a conductor and affixing grouting into each leg.

6. A method as claimed in claim 5 in which the strengthening step includes the additional step of placing the conductors in the sea bed to act as piles in addition to being casings for a well.

7. A method as claimed in claim 1 in which the raising step includes pulling up the deck to the working level with the jack-up rig.

* * * * *